US011591806B2

(12) United States Patent
Fahle

(10) Patent No.: US 11,591,806 B2
(45) Date of Patent: Feb. 28, 2023

(54) PANEL ELEMENT

(71) Applicant: Xylo Technologies AG, Niederteufen (CH)

(72) Inventor: Daniel Fahle, Dresden (DE)

(73) Assignee: Xylo Technologies AG, Niederteufen (CH)

( * ) Notice: Subject to any disclaimer, the term of this patent is extended or adjusted under 35 U.S.C. 154(b) by 0 days.

(21) Appl. No.: 17/285,841

(22) PCT Filed: Oct. 17, 2018

(86) PCT No.: PCT/EP2018/078452
§ 371 (c)(1),
(2) Date: Apr. 15, 2021

(87) PCT Pub. No.: WO2020/078549
PCT Pub. Date: Apr. 23, 2020

(65) Prior Publication Data

US 2021/0381252 A1 Dec. 9, 2021

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0161* (2013.01); *E04F 2201/041* (2013.01); *E04F 2201/043* (2013.01)

(58) Field of Classification Search
CPC ..... E04F 15/02038; E04F 13/0894; E04F 2201/0161; E04F 2201/043;
(Continued)

(56) References Cited

U.S. PATENT DOCUMENTS

2003/0205017 A1* 11/2003 Palmberg ..... E04F 15/02 52/592.1
2010/0218450 A1* 9/2010 Braun ..... F16B 5/0056 52/745.21
(Continued)

FOREIGN PATENT DOCUMENTS

CA 3060635 A1 * 11/2018 ..... E04F 15/02038
CN 1849431 A 10/2006
(Continued)

OTHER PUBLICATIONS

Eurasian Office Action with English Translation for Patent Application No. 202190772 dated Dec. 21, 2021, 5 pages.
(Continued)

*Primary Examiner* — Brent W Herring
(74) *Attorney, Agent, or Firm* — Crowell & Moring LLP

(57) ABSTRACT

A panel element may be provided for a covering. In particular, a panel element for a floor, wall or ceiling covering, which covering may be formed by a plurality of panel elements of the same kind which are connected to one another. Each panel element has a basic body having a defined total thickness and upper and a lower surfaces. The basic body has in each case differently contoured longitudinal sides and in each case differently contoured end faces. One longitudinal side has groove-like contouring and the other longitudinal side has tongue-like contouring corresponding thereto.

13 Claims, 2 Drawing Sheets

(58) Field of Classification Search
CPC ..... E04F 2201/023; E04F 2201/041; E04F 15/02; E04F 15/03
USPC ..... 52/588.1, 589.1, 590.3, 592.1, 592.4
See application file for complete search history.

(56) References Cited

U.S. PATENT DOCUMENTS

| | | | | |
|---|---|---|---|---|
| 2011/0016822 | A1* | 1/2011 | Braun | E04F 15/02 52/745.13 |
| 2011/0258959 | A1* | 10/2011 | Braun | E04F 15/02 52/588.1 |
| 2012/0096801 | A1* | 4/2012 | Cappelle | E04F 15/02038 52/592.1 |
| 2013/0192158 | A1* | 8/2013 | Cappelle | B32B 27/40 52/588.1 |
| 2013/0309441 | A1* | 11/2013 | Hannig | E04F 15/02038 29/428 |

FOREIGN PATENT DOCUMENTS

| | | | | |
|---|---|---|---|---|
| DE | 202 03 311 | U1 | 6/2002 | |
| DE | 20 2012 005 363 | U1 | 8/2013 | |
| DE | 202018006151 | U1 * | 6/2019 | E04F 15/102 |
| EP | 2 208 835 | A1 | 7/2010 | |
| FR | 2 826 391 | A1 | 12/2002 | |
| FR | 2871826 | A1 * | 12/2005 | E04F 15/04 |
| WO | WO-2005088029 | A1 * | 9/2005 | E04F 13/08 |

OTHER PUBLICATIONS

Chinese Office Action and Search Report with English Translation for Chinese Patent Application No. 201880098776.8 dated Dec. 24, 2021, 21 pages.
International Search Report for Application No. PCT/EP2018/078452, dated Jun. 3, 2019, pp. 1-2.

* cited by examiner

PANEL ELEMENT

CROSS-REFERENCE TO RELATED APPLICATIONS

This application is a 371 nationalization of international patent application PCT/EP2018/078452 filed Oct. 17, 2018, the entire contents of which is hereby incorporated by reference.

DETAILED DESCRIPTION

Figure 1:
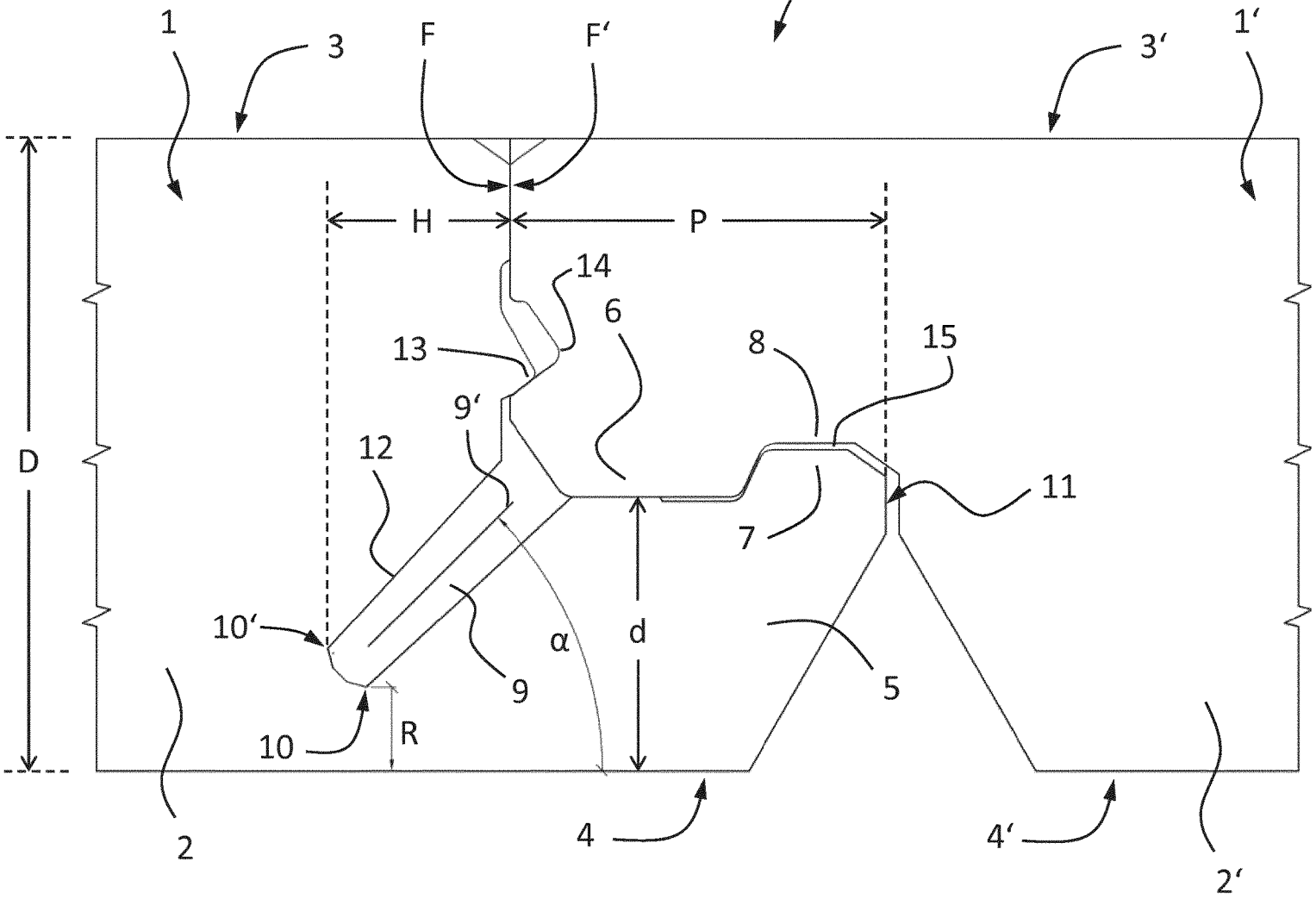
FIG. 1 shows a connection of two panel elements 1, 1' according to the present invention.

The present invention relates to a panel element for a covering, in particular a floor, wall or ceiling covering, which covering is formed by a plurality of panel elements of the same kind which are connected to one another. Each panel element has a basic body having a defined total thickness and upper and a lower surfaces. The basic body has in each case differently contoured longitudinal sides and in each case differently contoured end faces. One longitudinal side has groove-like contouring and the other longitudinal side has tongue-like contouring corresponding thereto. Additionally, the end faces are designed for latching from above with end faces of adjacent panel elements. A bottom leg projecting from the basic body at the end face is provided on at least one end face and a top leg projecting from the basic body at the end face is provided on the opposite side end face, wherein the bottom leg has a defined leg thickness. A projection for horizontal locking is provided on one leg in particular on the bottom leg, and a matching opening for horizontal locking is provided on the opposite leg, preferably on the top leg. In the protruding bottom leg and/or the basic body a notch is formed which has a direction component perpendicular to the lower surface of the panel element and has an a vertical end point, so that a ratio of a residual thickness, defined by as the distance of the vertical end point of the notch, and the lower surface of the panel element and the total thickness of the panel element is in between 0.04 and 0.50. Alternatively or in addition, the notch has a direction component parallel to the lower surface of the panel element and has a horizontal end point, so that a ratio of a horizontal extension, defined as the distance of a projection of the horizontal end point of the notch and the end face onto the lower surface of the panel element, and the total thickness of the panel element is in between 0.07 and 0.90.

In the field of interior design or to create new walls or partitions, it is often necessary to attach resistant coverings on floor, wall or ceiling surfaces. In the field of floor coverings, for example, laminate flooring has recently gained acceptance for numerous applications. There is also parquet or plastic coverings. Such coverings are composed of panel elements which are to be attached to each other or to the substrate in such a way that they remain permanently in the installed position. According to this, it must be prevented, in particular, that visible joints occur between individual, adjacent panel elements. This applies equally to panels from the field of interior work, which are used for the cladding of wall or ceiling surfaces, in particular roof slopes, as well as for the creation of new walls or partitions.

A panel element of the type mentioned is already known from DE 202 03 311 U1. The known panel element is one for a parquet floor. The known panel element has a basic body with longitudinal sides and head sides, which are each contoured differently.

Figure 2:
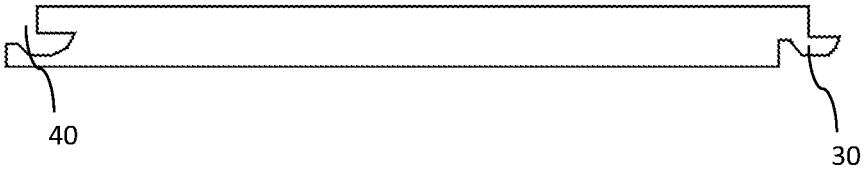

One of the longitudinal sides 40 has a groove-like contouring, while the other longitudinal side 30 has a tongue-like contouring (see FIG. 2). The contouring of the longitudinal sides is such that a panel element to be newly laid can first be inserted with its tongue-like longitudinal side 30 into the groove of the already laid panel element and then pivoted inward. In this way, a connection results on the long sides. In order to also connect the end faces, these are designed in the manner of a so-called snap connection.

A snap connection represents a latching connection that follows from above. The latching connection is obtained when after inserting the tongue of one panel element in the groove of the already laid panel element the to be laid panel element is pivoted in its final position in the installed state. When swiveling in the panel element or the movement downwards the locking takes place via the snap connection.

In recent years, a tendency has been observed, that the panels become thinner and the connection elements, provided on the longitudinal and end faces of the according panels become more subtle.

E. g. the basic body of the known panel element has a thickness of ca. 10 mm. A common thickness or strength of the body of the panel element for a parquet covering is 13.1 mm. In the case of such a panel element, the protrusion for horizontal locking projecting downwards from the thigh has a height h of approximately 4 mm or, on the underside, protrudes downwards by approximately 4 mm from the thigh. The thickness of the thigh between the locking projection and the main body is greater than 6 mm, while the lower leg still has a thickness of approximately 1.7 mm at its narrowest point.

When connecting the above-mentioned panel element, especially with the aforementioned snap connections or latching connections, a major drawback is, that the rigid protruding elements are prone to breaking, when installing or connecting the panels. Especially in the case, that panels are reused or deinstalled, the very subtle connecting members can be damaged.

Accordingly, it is the objective of the present invention, to provide connecting elements, especially at the end faces, to alleviate a latching connection, so that the connecting members at the end faces become flexible and thus less likely to be broken during the connection of the panels. Furthermore, the present invention intends to enable the locking elements of the connection elements at the end faces of the panels to protrude as little as possible in order to reduce waste, when producing or milling out the panels.

The notch geometry of the present invention can have the triple advantage of creating an elongated elastic cantilever by the bottom leg, of thinning the cantilever to a thickness which is well balanced for stability and for elasticity and of placing that cantilever in the bottom region of a panel, which in the case of a basic body made of MDF or HDF is significantly more stable than the middle region of such a panel, since upper and lower regions proportionally contain more glue than the middle region.

Especially when the material from which the panel elements are made are produced by means of pressing—such as e.g. being used in the production of MDF- or HDF-boards, chipboards or OSBs—these boards normally have a higher density and thus rigidity at their surfaces. Thus, when milling out notches especially from panels as mentioned above, the tools used for milling the notches have a tendency to wear faster if the surface areas of the panel are included in the milling process. It is accordingly a further objective of the present invention to allow the design, course or path of a notch within a panel element that allows their production with less wear occurring in the milling tools.

The present invention furthermore aims to design the notch adapted to specific circumstances, so to say to adapt the elasticity provided to the panel element by the notch.

According to the present invention there is provided a panel element for a covering, in particular a floor, wall or ceiling covering, wherein the covering is formed by a plurality of panel elements of the same kind which are connected to one another, wherein the panel element has a basic body having a total thickness, wherein the panel element has an upper surface and a lower surface, wherein the basic body has in each case differently contoured longitudinal sides and in each case differently contoured end faces, wherein one longitudinal side has groove-like contouring and the other longitudinal side has tongue-like contouring corresponding thereto, wherein the end faces are designed for latching from above with end faces of adjacent panel elements, wherein a bottom leg projecting from the basic body is provided on one end face and a top leg projecting from the basic body is provided on the opposite end face, said bottom leg having a leg thickness, wherein a projection for horizontal locking is provided on one leg, in particular on the bottom leg, and a matching opening for horizontal locking is provided on the opposite leg, preferably on the top leg, characterized in that in the protruding bottom leg and/or the basic body a notch is formed, wherein the notch has a direction component perpendicular to the lower surface of the panel element and has a vertical end point, so that a ratio (R/D) of a residual thickness (R), defined as the distance of the vertical end point of the notch, and the lower surface of the panel element and the total thickness (D) of the panel element is in between 0.04 and 0.50, and/or wherein the notch has a direction component parallel to the lower surface of the panel element and has a horizontal end point, so that a ratio (H/D) of a horizontal extension (H), defined as the distance of a projection of the horizontal end point of the notch and the end face onto the lower surface of the panel element, and the total thickness (D) of the panel element is in between 0.07 and 0.90.

The present invention provides a panel element, which has two different installing mechanisms provided at the respective sides. At the longitudinal sides, groove-like contouring and tongue-like contouring is present in order to allow an installation of the panels e. g. by angling along the longitudinal sides. Simultaneously with the installation of the panels along their long sides, also a connection at the end faces is possible. The panels according to the present invention comprise two end faces which comprise corresponding panel elements which can be installed with each other in order to allow horizontal and/or vertical securing of the installed panels at the end faces.

At one end face, the panels comprise a protruding or projecting bottom leg. At the opposite end face, the panel comprises a corresponding top leg, which allows installation of two or more panels at the corresponding opposite end faces. Said legs comprise a projection for horizontal locking and a matching opening, which allows a locking of the end faces with each other.

According to the present invention, a notch is provided at the leg and/or the basic bodies of the panel element, which e. g. can be a recess or a undercut. The notch e. g. can be produced by means of milling out material at the according location where the notch is to be installed.

The effect of the notch is to thin out the thickness of the bottom leg installed at one end face of the panel element, thereby providing additional flexibility to the bottom leg. However, it is to be ensured, that a specific residual thickness, when milling out the notch in the vertical direction is left in order to ensure sufficient mechanical strength of the connection of the basic body and the bottom leg.

The present invention accordingly provides a notch within a panel element which avoids that the notch encompasses parts of the surface of a panel element and thus parts of the panel element having a higher density and rigidity compared with the inner parts of the panel elements. When the notch is produced in the panel it thus can be avoided that parts of the panel with the highest rigidity must be milled. Only the relative soft parts of the panel must be processed. Accordingly the path or course of the notch according to the present invention allows an improved manufacturability and longer service life of the tools used during processing.

A further advantage is the transfer of the elasticity property into the area with high density of the panel, especially when made of compacted materials like HDF, MDF OSB, chipboard etc, where this property and the property of the required strength is given. This results in a prestressing at the end faces and an improvement of the technical properties compared to the susceptibility to cracking under loading of the joint. Thus, significantly better values are achieved in chair roll tests with impact sound underlay without losing tensile strength.

In the alternative or in addition, the notch is led to a horizontal end point, having the effect, that some kind of undercut is formed, which virtually lengthens the bottom leg. Accordingly, when the bottom leg is bent, e. g. when two panel elements are installed with each other at the end faces, the pivot point is moved to a location lying inside the panel element. Accordingly, the bottom leg becomes more flexible, so that the leg bends to the same extent, even when lesser or smaller forces are applied during the connection of the panel elements. Additionally, this feature allows the shortening of the protrusion or projection of the bottom leg, so that the protrusion of the bottom leg beyond the end face becomes shorter. This obviously also has an impact on the protrusion of the top leg on the opposite end face of the panel element, which can be shortened in the same manner. Accordingly, less material needs to be milled away from the panel element, when milled out from a large panel board, allowing a more economical way of production of the element.

In a specific embodiment, the notch has a direction component perpendicular to the lower surface of the panel element and has a vertical end point, so that a ratio (R/D) of a residual thickness (R), defined as the distance of the vertical end point of the notch, and the lower surface of the panel element and the total thickness of the panel element is in between 0.04 and 0.50, and at the same time the notch has a direction component parallel to the lower surface of the panel element and has a horizontal end point, so that a ratio of a horizontal extension, defined as the distance of a projection of the horizontal end point of the notch and the end face onto the lower surface of the panel element, and the total thickness (D) of the panel element is in between 0.07 and 0.90.

It is furthermore preferred, if the above-defined ratio (R/D) is in between 0.05 and 0.40, preferably in between 0.06 and 0.35, especially preferred in between 0.06 and 0.15.

Alternatively or in addition, it is preferred, if the above-defined ratio (H/D) is in between 0.10 and 0.70, preferably in between 0.11 and 0.50, especially preferred in between 0.12 and 0.36.

According to a further aspect of the present invention it is preferred, that the bottom leg projecting from the basic body so that a ratio (P/D) of the protrusion (P) of the bottom leg, said protrusion being defined as the distance of a projection of a maximum horizontal extension of the bottom leg and the end face onto the lower surface, and the total thickness (D) of the panel element is in between 0.20 and 2.00, preferably in between 0.40 and 1.5, especially preferred in between 0.50 and 1.30.

Accordingly, the protrusion of the bottom leg can be very little, so that the installation members or locking members at the end faces of the panel element can be very compact.

In an additionally preferred aspect of the present invention, the bottom leg projecting from the basic body and the notch has a direction component parallel to the lower surface of the panel element so that a ratio ((H+P)/D) of the sum of the horizontal extension and the protrusion of the bottom leg in relation to the total thickness, wherein (H) and (P) are defined as in the aforementioned claims, is in between 0.50 and 2.00, preferably in between 0.70 and 1.80, especially preferred in between 0.80 and 1.70.

Furthermore, it is possible, that the notch is bounded by two walls which each are linear or planar and/or are parallel or non-parallel to form a conical notch.

It is additionally preferred, if that the notch has a course which includes an angle with the lower surface which is in between 5 and 165°, preferably in between 10 and 145°, preferably in between 20 and 120°, especially preferred in between 25 and 50°. For example, the course of a conical notch, i.e. a notch shaped by conical walls, is defined by the symmetric axis of its conical walls.

Especially preferred the notch has a direction component parallel to the lower surface of the panel element which is opposite to the protruding leg, i.e. the notch has a course that virtually lengthens the leg by being led into the basic body thus running away from the leg.

Furthermore, it is possible that the notch starts at the location where the bottom leg protrudes.

It is furthermore preferred, if the notch has a maximum width which is in between 0.5 and 3.0 mm, preferably in between 1.5 and 2.0 mm. If e.g. the walls defining the notch are parallel, the width of the notch will not vary so that the actual width of the notch is equal over the complete extension if the notch. The width of the notch will be measured perpendicular to the walls. In this case the maximum notch width is the actual width of the notch. If, however, the walls of the notch are not parallel, e.g. conical, the width of the notch varies over its extension. Accordingly, the maximum width is the position of the notch where the distance of the walls has a maximum value. The width of the notch when the walls are e.g. conical to each other will be measured perpendicular to the course of the notch as defined above.

According to a further embodiment of the present invention locking members for locking the panel elements in a direction perpendicular to the lower surface are present at the end faces. The locking members provide additional vertical support to the panel elements to prevent any unintended vertical displacement of the panel elements in the installed shape. For example the locking members comprise a tongue projecting beyond the end face and a corresponding groove (at the opposite end face of the panel element) made for receiving said tongue when the panel elements are installed along the end faces.

Preferably the panel elements in the installed state have vertical contact only in the area of the bottom leg and the top leg and, if present, the locking members. Especially in this embodiment the special shape of the notch according to the present invention is particularly advantageous by contributing to the elasticity of the bottom leg not only during installation of the panels, but also in the installed state. For example, the projection for horizontal locking and the corresponding opening can be separated by a gap when the panel elements are installed along the end faces.

The surfaces of the panel element can be treated or compounded with additional material layers. Especially, the lower surface can be provided with a counterdraw layer and/or the upper surface can be provided with at least one layer selected from a décor layer and an abrasion resistant layer. The layers forming the top layers, i.e. the additional layers present on the top upper surface of the basic body can be structured to have a 3D profiling etc.

The basic body can be made of virtually any material, however MDF, HDF, thermoplastic resins, especially PVC, wood, chipboard, OSB and/or fibre cement are especially preferred.

The present invention is furthermore described by the accompanying figures:

FIG. 1 shows a connection of two panel elements 1, 1' according to the present invention. Displayed is a cross section through the end faces F, F' of the panel elements 1, 1'. The panel elements 1, 1' have a basic body 2, 2'. The panel elements 1, 1' each have upper surfaces 3, 3' and lower or bottom surfaces 4, 4'. In FIG. 1, two panel elements 1, 1' are shown in an installed manner, wherein the panel elements are connected along their end faces F, F' to form a covering 100, which e.g. can be floor covering. FIG. 2 shows a cross section of a panel element according to the present disclosure, including one longitudinal side 40 with an exemplary groove-like contouring, and another longitudinal side 30 with an exemplary tongue-like contouring.

The panel elements 1, 1' comprise a protruding leg 5 at the bottom side (i. e. a bottom leg) at one end face F. In addition, on the opposite side, a top leg 6 is present. In the examples shown in FIG. 1, the bottom leg 5 is provided with a projection for horizontal locking 7, whereas the top leg 6 is provided with a matching opening for horizontal locking 8. The projection for horizontal locking 7 provided on the leg 5 gives the leg the shape of a hook. When installing two panel elements 1, 1' with each other, the projection 7 engages with the matching opening 8 in order to provide a horizontal locking element. However, it is equally possible to provide the bottom leg 5 with a opening for horizontal locking and the top leg 6 with a matching projection for horizontal locking.

The panel elements 1, 1' have an overall thickness D, which is the distance from the upper surface 3, 3' to the lower surface 4, 4'. The protruding bottom leg 5 has a thickness d, which is the distance from its upper surface (with the exception of an eventual present projection 7 or opening 8) to the bottom surface 4, 4'.

As can be seen from FIG. 1, a notch 9 is milled out in the basic body 2, 2' under an angle $\alpha$, thus virtually elongating the bottom leg 5. Preferably, the angle $\alpha$ e. g. can be in a range in between 15 and 165°, in the example shown in FIG. 1, the angle $\alpha$ e. g. is 45°. The notch 9 has a course 9' which in the example shown in FIG. 1 is a linear course. The notch is confined by two walls 12.

The notch 9 accordingly can be described as a three-dimensional cavity. The point closest to the lower surface 4, 4' of the panel element 1, 1' is defined as the vertical end point 10 of the notch 9, whereas the point which is in horizontal direction extending at most in direction of the basic body 2, 2' can be defined as the horizontal end point 10' of the notch 9.

According to the present invention, the notch 9 has a dimension in the vertical direction (and accordingly a vertical component), so that a ratio of the residual thickness R—which is the distance of the vertical end point 10 measured perpendicular to the lower surface 4, 4'—to the overall or total thickness D of the panel elements 1, 1' can be—as exemplified in FIG. 1—ca. 0.11.

In the alternative or in addition to the aforementioned embodiment it is also possible, that the notch 9 has a horizontal direction component, i. e. a direction component which is parallel to the lower surface 4, 4' of the panel element 1, 1'. Accordingly, the notch has a horizontal extension H, defined as the distance of a projection of the horizontal end point 10' of the notch 9 and the end face F onto the lower surface 4, 4' of the panel elements. Again, the aforementioned projections are made perpendicular to the lower surface 4, 4'. In the example shown in FIG. 1, the ratio H/D of the notch 9 e. g. can be 0.25.

Furthermore, the bottom leg 5 extends beyond the end face F up to an end point 11. The point 11 corresponds to the maximum horizontal extension of the bottom leg 5, with regard to the position of the end face F (again, the distance is calculated by an according projection of the both horizontal positions of the end point 11 and the end face F onto the bottom surface 4, 4' of the panel element 1, 1'). In the examples shown in FIG. 1, the ratio of the protrusion P to the overall thickness D of the panel element 1, 1' e. g. can be 0.50. Accordingly, the protrusion of the bottom leg 5, with respect to the thickness of the panel element 1, 1' can be considerably reduced. The virtual lengthening of the leg 5, especially by providing a horizontal direction component of the notch 9 ensures, that enough flexibility is present in the bottom leg 5. Accordingly, material can be saved, when the panel elements 1, 1' are milled.

In addition, a ratio (H+P)/D can be—as shown in the example according to FIG. 1—e. g. 0.75.

It is advantageous, moreover, that the embodiment according to the invention with a comparatively small projection is readily possible not only in the case of very thin coverings but also in the case of thicker coverings, such as parquet floors.

This has the advantage that the production of the locking connection can be made independently of the thickness of the lining.

To clarify the use of and to hereby provide notice to the public, the phrases "at least one of <A>, <B>, . . . and <N>" or "at least one of <A>, <B>, . . . or <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

The invention claimed is:

1. A panel element for a covering the panel element comprising:

a covering formed by a plurality of panel elements of the same kind which are connected to one another, a basic body formed in the panel element having a total thickness (D), wherein the panel element has an upper surface and a lower surface, wherein the basic body has in each case differently contoured longitudinal sides and in each case differently contoured end faces (F, F'), wherein one longitudinal side has groove-like contouring and the other longitudinal side has tongue-like contouring corresponding thereto, wherein the end faces (F, F') are designed for latching from above with end faces (F, F') of adjacent panel elements, a bottom leg projecting (P) from the basic body is provided on one end face (F) and a top leg projecting from the basic body is provided on the opposite end face (F'), the bottom leg having a leg thickness (d), wherein a projection for horizontal locking is provided on one leg and a matching opening for horizontal locking is provided on the opposite leg, wherein the end faces (F, F') have locking members for locking the panel elements in a direction perpendicular to the lower surface, one of the locking members for locking the panel elements in a direction perpendicular to the lower surface being arranged between the upper surface and the bottom leg on the end face (F) on which the bottom leg is provided, and one further of the locking members for locking the panel elements in a direction perpendicular to the lower surface being arranged at the top leg on the end face (F') on which the top leg is provided, and a notch is in the protruding (P) bottom leg and/or the basic body, wherein the notch starts at the location where the bottom leg protrudes, wherein the notch has a direction component perpendicular to the lower surface of the panel element and has a vertical end point, so that a ratio (R/D) of a residual thickness (R), defined as the distance of the vertical end point of the notch and the lower surface of the panel element, and the total thickness (D) of the panel element is between 0.05 and 0.40, and/or wherein the notch has a direction component parallel to the lower surface of the panel element and has a horizontal end point, so that a ratio (H/D) of a horizontal extension (H), defined as the distance of a projection of the horizontal end point of the notch and the end face (F) onto the lower surface of the panel element, and the total thickness (D) of the panel element is between 0.10 and 0.70.

2. The panel element of claim 1, wherein the bottom leg projecting (P) from the basic body so that a ratio (P/D) of the protrusion (P) of the bottom leg, the protrusion (P) being defined as the distance of a projection of a maximum horizontal extension of the bottom leg and the end face (F)

onto the lower surface, and the total thickness (D) of the panel element is between 0.20 and 2.00.

3. The panel element of claim 1, wherein the bottom leg projecting (P) from the basic body and the notch has a direction component parallel to the lower surface of the panel element so that a ratio ((H+P)/D) of the sum of the horizontal extension (H) and the protrusion (P) of the bottom leg in relation to the total thickness (D), is between 0.50 and 2.00.

4. The panel element of claim 1, wherein the notch is bounded by two walls which each are linear or planar and/or are parallel or non-parallel to form a conical notch.

5. The panel element of claim 1, wherein the notch has a course which includes an angle (α) with the lower surface which is between 5 and 165.

6. The panel element of claim 1, wherein the notch has a direction component parallel to the lower surface of the panel element which is opposite to the protruding leg.

7. The panel element of claim 1, wherein the notch has a maximum width (W) between 0.5 and 3.0 mm.

8. The panel element of claim 1, wherein the locking members comprise a tongue projecting beyond the end face (F) and a corresponding groove made for receiving the tongue when the panel elements are installed along the end faces (F, F').

9. The panel element of claim 1, wherein when the panel elements in the installed state have vertical contact only in the area of the bottom leg and the top leg and the locking members.

10. The panel element of claim 1, wherein the projection for horizontal locking and the opening for horizontal locking are separated by a gap when the panel elements are installed along the end faces (F, F').

11. The panel element of claim 1, wherein the lower surface is provided with a counterdraw layer and/or the upper surface is provided with at least one layer selected from a décor layer, an abrasion resistant layer or a three-dimensionally structured layer.

12. The panel element of claim 1, wherein the basic body is made of MDF, HDF, thermoplastic resins, including PVC, wood, chipboard, OSB and/or fibre cement.

13. The panel element of claim 12, wherein the basic body is made of PVC, wood, chipboard, OSB and/or fibre cement.

* * * * *